US007264083B2

(12) United States Patent
Wilcox

(10) Patent No.: US 7,264,083 B2
(45) Date of Patent: Sep. 4, 2007

(54) FRAMING SYSTEM SCAFFOLD HANGER

(76) Inventor: Wilson Fremondez Wilcox, 86 Brucker Road, Barrie, On. (CA) L4N 8H9

( * ) Notice: Subject to any disclaimer, the term of this patent is extended or adjusted under 35 U.S.C. 154(b) by 266 days.

(21) Appl. No.: 11/004,952

(22) Filed: Dec. 7, 2004

(65) Prior Publication Data

US 2006/0118361 A1 Jun. 8, 2006

(51) Int. Cl.
*E04G 3/00* (2006.01)

(52) U.S. Cl. ..... 182/82; 182/150

(58) Field of Classification Search ..... 182/82, 182/150; 248/228.4, 228.1
See application file for complete search history.

(56) References Cited

U.S. PATENT DOCUMENTS 494,868 A * 4/1893 Kelly ..... 182/189
3,084,893 A * 4/1963 Ruth ..... 248/228.4
3,510,097 A * 5/1970 McCaleb ..... 248/243
5,524,727 A * 6/1996 Yennie, Jr.
2003/0127283 A1* 7/2003 Deal ..... 182/82
2004/0007423 A1* 1/2004 Scott ..... 182/82

* cited by examiner

*Primary Examiner*—Alvin Chin-Shue
(74) *Attorney, Agent, or Firm*—D. W. Eggins

(57) ABSTRACT

A suspended scaffold, which hangs from the wall plate within a frame structure, has two hangar brackets attached to the wall plate. Each bracket has an outer retainer bar for insertion between the wall plate outer face and an adjoining sheathing panel. A cooperating clamp portion has a cross-bar lying upon the top face of the wall plate and a downwardly extending load bar and extension piece having a forwardly projecting braced foot which carries the platform lumber. Pivotal links connecting the clamp portion with the extension piece enable clamp opening/closing, and include disabling and safety locks that are engaged by the extension piece. The braced foot portion, which has a plank-retaining toe, can be folded up when free of platform lumber.

14 Claims, 2 Drawing Sheets

16
20
14
22
50
12
42
142
222
25
10
40
44
36
46
24
27
32
30
54
58
60
28
62
56
52
26
64

16
14
22
12
24
10
26
30
27
54
52
58
28
62

FRAMING SYSTEM SCAFFOLD HANGER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

This invention is directed to a framing system for the erection of building frames, and in particular to a scaffold assembly incorporating novel scaffold hangers.

The framing of timber building structures, as typically carried out in North American homes involves the erection of a frame for the building, constructed of standard sized two by four or two by six joists, with the framework being surmounted by a wall plate. Problems of worker safety increase when working above the first floor, as workers frequently stand and walk about on the narrow two by six wall plate.

The use of movable platforms is restricted in some jurisdictions, on grounds of safety, to a platform height of six feet, while suspended scaffolds are required to provide a "sill height" (the distance from platform level to safety barrier) with a minimum value (equivalent to waist-high) of about forty inches.

The provision of a suitably elevated interior working platform in the vicinity of the frame walls is complicated when the framing is enclosed by an outer sheathing such as four by eight (48 by 96 inch) panels, which can hinder clear access to the wall plate for a point of suspension.

BRIEF SUMMARY OF THE INVENTION

The present invention consists of a suspended platform with hangs from the wall plate on the interior of a frame structure. The platform consists of construction type lumber, which may be available on site, combined with a pair of novel suspension (scaffold) hanger brackets, which are readily suspended from a wall plate.

The subject scaffold brackets each includes an outer retainer bar for positioning against the outer face of the supporting wall plate. The shallow section of this retainer bar facilitates its insertion between the wall plate outer face and an adjoining sheathing panel. The cooperating clamp portion of the scaffold bracket includes a cross-bar portion which engages the top face of the supporting wall plate, an adjoining, downwardly extending load bar portion which lies close to or abuts the front face of the wall plate, from which extends downwardly an extension piece having a forwardly projecting foot portion, upon which the platform lumber is supported.

The foot portion, which carries the scaffold boards, is suspended from a brace plate that is connected to the lower end of the extension piece. The foot portion includes an upwardly turned toe, to retain the platform lumber in place.

In a hanger bracket embodiment having an upwardly pivotal foot, a brace member connecting the outer end of the foot to the brace plate is pinned at its ends, having a pivotal pin connection to the foot portion, and a sliding pin-in-groove connection with the brace plate. Each end of the brace member has a backing plate positioned as a back-stop, to contain any displacement of the brace member's pinned end connections when in its load-bearing condition.

An upwardly extending tooth projecting parallel with the toe may be provided, to receive and engage the innermost wooden platform member, positioning it closely adjacent the extension piece, which innermost platform member abuts the front face of wall frame members, with the scaffold hanger brackets per se being located between the frame joists.

The bracket extension piece may be connected to the clamp portion of the bracket by a four-link pivoted connection, to facilitate the application of the clamp portion to a wall plate. This connection may also include a safety lock, acted upon by the platform and its load, to prevent disengagement of the bracket clamp portion from its supporting wall plate when in a loaded condition.

A recess in the extension piece, to engage one of the pins of the four link connection, when in an unlocked, collapsed condition, facilitates downward withdrawal of the retainer bar when the hanger bracket is being dismounted.

The pivotal attachment of the bracket foot to the bracket extension piece permits the foot to be pivoted upwardly adjacent the bracket extension piece, for ease of packaging and to facilitate handling and transportation.

BRIEF DESCRIPTION OF THE SEVERAL VIEWS OF THE DRAWINGS

Certain embodiments of the invention are described by way of illustration, without limitation thereto other than as set forth in the accompanying claims, reference being made to the accompanying drawings, wherein:

DETAILED DESCRIPTION OF THE INVENTION

Figures 1, 2:
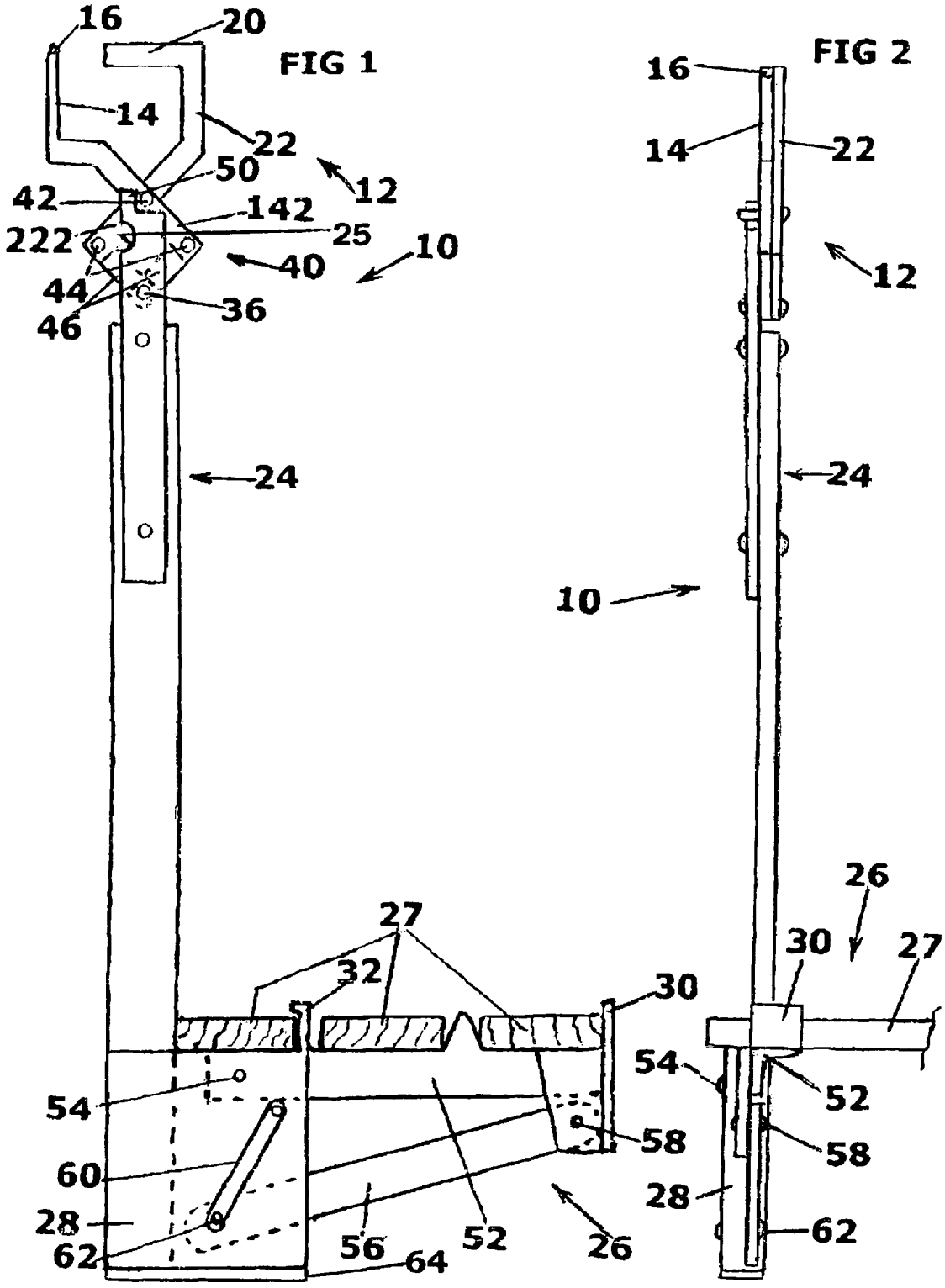
FIG. 1 is a side view in elevation of the hanger bracket and platform in accordance with the present invention.
FIG. 2 is a front elevation of one of the hangers and a portion of the platform; and, FIG. 3 is a perspective side elevation showing a portion of a framed wall having a scaffold incorporating the subject hanger brackets mounted thereon.
Figure 3:
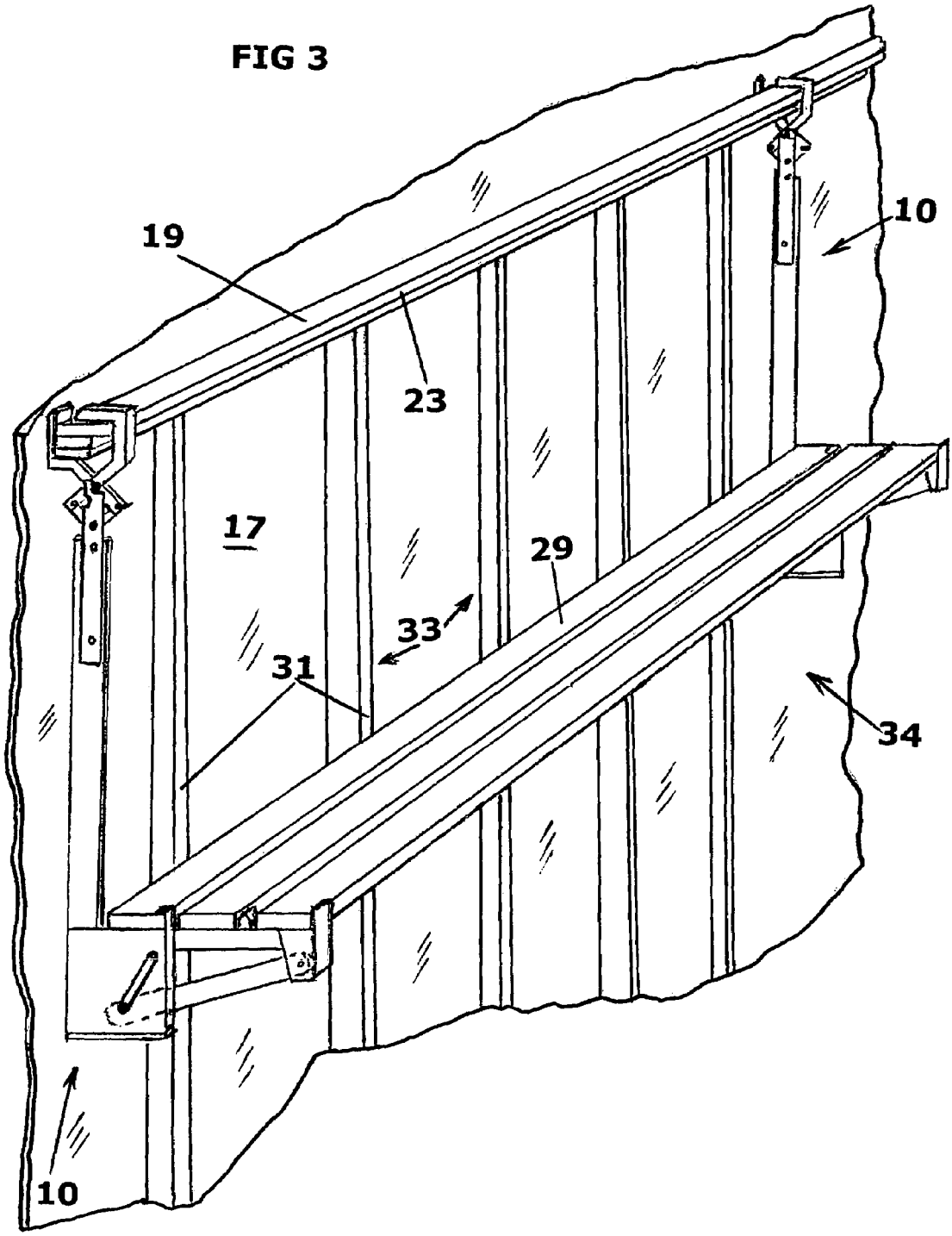

Referring to FIGS. 1, 2 and 3, the subject scaffold bracket 10 has an upper, clamp portion 12, with an outer retainer bar 14 having a wedge-shaped end 16 to facilitate insertion of the bar 14 between an outer sheathing 17 and wall plate 19 of a framed structure.

The clamp portion 12 has a cross-bar portion 20 which engages the top face of the supporting wall plate 19 and downwardly extending load bar portion 22, which lies close to or abuts the front face 23 of the wall plate 19. An extension piece 24 extends downwardly having a forwardly projecting foot portion 26, upon which the platform lumber 27 is supported.

The foot portion 26 has a brace plate 28 connecting it to the extension piece 24, and an upwardly extending toe plate 30, to retain the platform lumber 27 in place upon the foot portion 26. The lower portion of plate 30 serves as a back-up stop for a strut 56 (see below)

An upwardly extending tooth 32 projecting parallel with the toe plate 30 may be provided, to receive and engage the innermost wooden platform member 29, securing it closely adjacent the extension piece 24, The innermost platform member 29 abuts the front (inner) face 31 of wall frame stud members 33, to position the scaffold. The two hanger brackets 10 of a scaffold 34 are each thus located between a pair of stud members 33.

The bracket extension piece 24 is pivotally connected at 36 to the clamp portion 12 of the bracket by a four-link pivoted connection 40, to facilitate the application of the clamp portion 12 to a wall plate 19.

The connection 40 has a top pivot pin 42, two intermediate pivot pins 44 and a lower pivot pin 36 connecting two short links 46 to respective angled extension portions 142 and 222 of the retainer bar 14 and the load bar portion 22.

The rear edge of the extension piece 24 has a recess 25 which can be engaged with the adjacent intermediate pivot pin 44 when the connection 40 is in a collapsed condition. This engagement is effected by forwardly pivoting the lower end of the extension piece 24, so as to enter the pin 44 into the recess 25, whereby the connection 40 is locked in its collapsed condition. In this condition, the cross bar 20 of the clamp 12 being disabled in the OPEN condition, the retainer bar 14 can be forcibly inserted between or withdrawn from the sheathing 17 and the wall plate 19.

To mount the bracket 10 on a framed wall, the downward closing (by collapsing) of the connection 40 serves to open the clamp portion 12, inclining the cross-bar portion 20 inwardly towards the user, so that the end 16 of the retainer bar 14 can be inserted upwardly between the outer face of the wall plate 19 and the outer sheathing 17.

The opening-up of the connection 40, by downward displacement of the extension piece 24, then pivots the cross-bar portion 20 downwardly across the wall plate 19, to close the clamp portion 12. In this condition, a safety lock portion 50 of the extension piece 24 is engaged behind the projecting end of top pivot pin 42, to lock the clamp portion 12 in its closed position, thus preventing disengagement of the bracket clamp portion from its supporting wall plate. This condition is also promoted by the weight of the platform, and its applied load.

The bracket foot portion 26 consists of a plate 50 having a top arm 52 pivotally attached at 54, and a strut 56 pivotally attached at 58 to the top arm 52, and slidably connected by slot-and-pin connection 60/62 to the plate 50. The strut 56 is of angled section, to provide the required stiffness. A back-up plate 64, and toe plate 30, located behind the respective lower and upper ends of strut 56 provide additional safety factors to the respective pin connections at 60/62 and 58.

In the "open" condition, as illustrated, the top arm 52 is supported in a braced condition by the strut 56, the pin 62 of which engages the bottom end of the slot 60.

When the platform is disassembled and dismounted, the top arm 52 can be folded up towards the extension piece 24, the pin 62 being drawn upwardly to the top of the slot 60.

This facilitates handling, packaging and transportation of the bracket 10. The span of the platform in the present embodiment is limited to six feet, and the use of new lumber for the platform members is a requirement, for purposes of safety.

Under provincial regulations, the height of the platform above floor level is limited to five feet.

It will of course be understood that the present invention has been described above purely by way of example, and modifications of detail can be made within the scope of the invention as defined in the appended claims.

The invention claimed is:

1. A load bearing hanger for attachment to the interior face of a frame wall having an outer sheath, said frame wall having a load bearing beam, said hanger having clamp means for attachment to said beam, said clamp means having a cross bar portion, to engage the top of said beam, a retainer bar to abut a vertical face of said beam adjoining said outer sheath, said retainer bar being inserted upwardly between said vertical face and said outer sheath a load bar portion extending downwardly from and supported solely by said clamp means, having an extension portion, a foot portion extending horizontally from said extension portion, to receive platform members in supported relation thereon, said retainer bar preventing withdrawal of said load bar from off said beam, and locking means positively securing said retainer bar and said cross bar portion in mutually fixed, clamping relation when said foot portion is in a loaded condition.

2. The hanger as set forth in claim 1, said cross bar portion and said retainer bar being connected with said load bar extension portion by way of pivoted link means, to permit displacement of said retainer bar in spaced-open relation from said cross bar portion, to facilitate positioning of said retainer bar against said beam face.

3. The hanger as set forth in claim 2, said pivoted link means being pivotally mounted on said load bar extension portion, to enable pivotal displacement of said load bar extension portion relative to said pivoted link means, for engaging and disengaging said locking means.

4. The hanger as set forth in claim 1, said retainer bar having a wedge-shaped upper end, to facilitate insertion of the retainer bar between said outer sheathing and said beam vertical face.

5. The hanger as set forth in claim 2, said pivoted link means having a pair of short links pivotally connected to the upper end of said load bar extension portion, connecting with said retainer bar and said load bar portion intermediate their respective ends, to enable opening lateral displacement between their respective upper ends, for placement of said cross bar, said retainer bar and said load bar about said beam.

6. The hanger as set forth in claim 1, said foot portion including a brace plate connected to said extension piece, having a bracing strut connecting said brace plate to a top arm portion of said foot portion in load transfer relation therebetween.

7. The hanger as set forth in claim 6, said foot portion having an upwardly protruding toe portion adjacent its outer end, to restrain a platform board against outward displacement when placed upon the hangar foot portion.

8. The hanger as set forth in claim 7, said foot portion having an upwardly extending tooth projecting parallel with said toe portion, to receive and engage an innermost board platform member, to position it closely adjacent said load bar extension portion.

9. The hanger as set forth in claim 2, said load bar extension having a recessed edge portion to engage said pivoted link means when in a closed condition, to maintain said closed condition and to facilitate withdrawal of said retainer bar, in dismounting said hanger from said beam.

10. The hanger as set forth in claim 6, said foot portion including backing plate means located closely adjacent the ends of said bracing strut, to provide safety back-up of said strut when in a loaded condition.

11. The hanger as set forth in claim 1, in combination with a second said hanger in predetermined spaced relation therefrom, suspended from said beam, with a plurality of boards of predetermined minimum cross-section extending between said hangers, being supported upon the respective said foot portion, to form a platform.

12. A load bearing hanger for attachment to a load bearing beam, said hanger having a cross bar portion, to engage the top of said beam, a retainer bar to abut one vertical face of said beam, a load bar portion extending downwardly from said cross bar, having an extension portion, and a foot portion extending horizontally from said extension portion, to receive platform members in supported relation thereon, said foot portion including a brace plate connected to said extension piece, having a bracing strut connecting said brace plate to a top arm portion of said foot portion in load transfer relation therebetween by way of a pin located in an inclined slot, to permit upward pivotal displacement of said bracing strut on upward pivotal refraction of said top arm portion, said retainer bar preventing withdrawal of said load bar from off said beam when in a loaded condition.

13. A load bearing first hanger for attachment to a load bearing beam, in combination with a second said hanger in predetermined spaced relation from said first hanger and suspended from said beam, said hangers each having: a cross bar portion, to engage the top of said beam, a retainer bar to abut one vertical face of said beam, said retainer bar being inserted upwardly between said beam vertical face and an adjoined outer sheathing, said retainer bar preventing withdrawal of said load bar from off said beam when in a loaded condition, a load bar portion extending downwardly from said cross bar, having an extension portion, and a foot portion extending horizontally from said extension portion; and a plurality of boards of predetermined minimum cross-section extending between said hangers, being supported upon the respective said foot portions, to form a platform.

14. The hangar as set forth in claim 1, wherein in use, said cross bar portion of said clamp means extends across said load bearing beam in spaced relation from said retainer bar.

* * * * *